US005205753A

United States Patent [19]

Butterfield et al.

[11] Patent Number: 5,205,753

[45] Date of Patent: Apr. 27, 1993

[54] CIRCUIT BOARD STRUCTURE

[75] Inventors: David J. Butterfield; Birney D. Dayton, both of Nevada City, Calif.

[73] Assignee: NVision, Inc., Nevada City, Calif.

[21] Appl. No.: 864,493

[22] Filed: Apr. 7, 1992

[51] Int. Cl.[5] ..... H01R 13/629

[52] U.S. Cl. ..... 439/157; 439/310

[58] Field of Search ..... 439/61, 64, 65, 259, 439/260, 157, 310

[56] References Cited

U.S. PATENT DOCUMENTS

| | | | |
|---|---|---|---|
| 3,587,031 | 6/1971 | Flavin | 439/260 |
| 4,392,700 | 7/1983 | Showman et al. | 439/260 |
| 4,470,100 | 9/1984 | Rebaudo et al. | 439/59 |
| 4,840,575 | 6/1989 | Matsuoka | 439/267 |
| 4,875,873 | 10/1989 | Ishizuka et al. | 439/347 |
| 4,984,383 | 1/1991 | Mummey et al. | 439/259 |
| 5,030,108 | 7/1991 | Babow et al. | 439/64 |

*Primary Examiner*—Neil Abrams
*Attorney, Agent, or Firm*—Dellett, Smith-Hill and Bedell

[57] ABSTRACT

A circuit board comprises a substrate, a connector part, and a mounting mechanism attaching the connector part to the substrate at an edge thereof in a manner allowing forcible movement of the connector part relative to the substrate in a direction having a component perpendicular both to its edge and to a line normal to the substrate. When the substrate is held stationary relative to a connector part that is complementary to the first-mentioned connector part and is presented toward the first-mentioned connector part, the mounting mechanism can be employed to advance the first-mentioned connector part into engagement with the complementary connector part.

11 Claims, 4 Drawing Sheets

CIRCUIT BOARD STRUCTURE

BACKGROUND OF THE INVENTION

This invention relates to a circuit board structure.

Many electronic instruments are composed of multiple circuit boards. Each circuit board comprises a substrate and various electronic components mounted on the substrate and interconnected by conductor runs that are incorporated in the substrate. Commonly, the circuit boards are arranged side-by-side in parallel relationship in a card cage, for example as shown in U.S. Pat. No. 5,030,108 (Babow et al). The circuit boards are inserted into the card cage through an opening at the front of the card cage, and are pushed towards the rear of this card cage. It is generally necessary that the circuit boards be interconnected with each other or connected to other equipment, and this may be accomplished by use of a backplane structure that extends across the rear of the card cage. Each circuit board includes at least one connector part at its rear edge and the backplane structure includes a complementary connector part that is engaged by the connector part of the circuit board when the circuit board is fully inserted in the card cage. A complex instrument might comprise several rows of circuit boards arranged one above the other. Circuit boards in a row at one level are connected to circuit boards at a different level through the backplane structure. This approach is subject to limitation in that the backplane structure must be able to accommodate planned expansion or else be replaced when expansion is necessary.

It is well known to construct a flexible electronic instrument having several different configurations by providing a mainframe unit that includes parts that are common to all configurations and installing plug-in modules in the mainframe unit. On installation in the mainframe unit, a plug-in module is connected to a backplane structure of the mainframe unit, and the backplane structure provides the necessary connections to the functional parts of the mainframe unit and to the other plug-in modules. Some of the modules might be functionally identical, while others might have different functions. This allows the capabilities of the instrument to be changed simply by addition of modules or replacing existing modules with different modules. However, in this type of instrument the number of plug-in modules that can be accommodated by the mainframe unit is limited.

SUMMARY OF THE INVENTION

Co-pending patent application Ser. No. 07/614,230 filed Nov. 15, 1990, the disclosure of which is hereby incorporated by reference herein, discloses a crosspoint switcher including at least one row of essentially identical circuit boards each comprising a substrate and at least one switch module having a plurality of signal in terminals, a plurality of signal out terminals, and a plurality of input expansion terminals. The switch module is operative to connect any selected signal in terminal to any selected subset of signal out terminals and is also operative to connect any input expansion terminal selectively to a corresponding signal out terminal. The module also has a control in terminal for receiving a control word from a crosspoint controller, and a control out terminal. The control word is used by the switch module to determine which, if any, connections are made in the switch module. In a practical implementation of the switcher disclosed in the co-pending application, the circuit boards are installed in a card cage and the connections to the signal in terminals of the circuit boards are made through the backplane structure of the card cage. The number of input terminals that can be supported by the switcher depends on the number of signal in terminals, and the number of signal in terminals can be increased by installing an additional row of circuit boards in a card cage compartment above the existing rows of circuit boards and connecting the signal out terminals of the additional row of circuit boards to the input expansion terminals of the previous top row of circuit boards and connecting the control in terminals of the additional row of circuit boards to the control out terminals of the previous top row of circuit boards. The practical implementation comprises a mainframe unit that includes power supplies, output circuitry and control circuitry.

In accordance with a first aspect of the present invention there is provided a circuit board comprising a generally planar substrate having first and second opposite edges, a first connector part attached to the substrate at its first edge, a second connector part, complementary to the first connector part, and mounting means attaching the second connector part to the substrate at its second edge in a manner allowing forcible movement of the second connector part relative to the substrate in a direction having a component perpendicular both to the second edge and to a line normal to the substrate, whereby when the circuit board and a second circuit board that is identical to the first-mentioned circuit board are held in substantially coplanar relationship with the first connector part of the second circuit board spaced from but presented toward the second connector part of the first-mentioned circuit board, the mounting means of the first-mentioned circuit board can be employed to advance the second connector part of that circuit board from a first position in which it is spaced from the first connector part of the second circuit board to a second position in which it engages the first connector part of the second circuit board.

In accordance with a second aspect of the present invention there is provided a circuit board comprising a substrate, a connector part, and mounting means attaching the connector part to the substrate at an edge thereof in a manner allowing forcible movement of the connector part relative to the substrate in a direction having a component perpendicular both to said edge and to a line normal to the substrate, whereby when the substrate is held stationary relative to a connector part that is complementary to the first-mentioned connector part and is presented toward the first-mentioned connector part, the mounting means can be employed to advance the first-mentioned connector part into engagement with the complementary connector part.

In accordance with a third aspect of the present invention there is provided an electronic instrument comprising a first circuit board comprising a substrate and a connector part attached to the substrate at an edge thereof, a second circuit board comprising a substrate, a connector part that is complementary to the connector part of the first circuit board, and mounting means attaching the connector part of the second circuit board to the substrate thereof at an edge of the substrate in a manner allowing forcible movement of the connector part relative to the substrate in a direction having a component perpendicular both to said edge and to a line normal to the substrate of the second circuit board, and means supporting the first and second circuit boards so that their substrates are in substantially coplanar relationship and the connector part of the first circuit board is presented toward the connector part of the second circuit board, whereby the mounting means can be employed to advance the connector part of the second circuit board into engagement with the connector part of the first circuit board.

BRIEF DESCRIPTION OF THE DRAWINGS

For a better understanding of the invention and to show how the same may be carried into effect, reference will now be made, by way of example, to the accompanying drawings in which.

DETAILED DESCRIPTION

Figure 1:
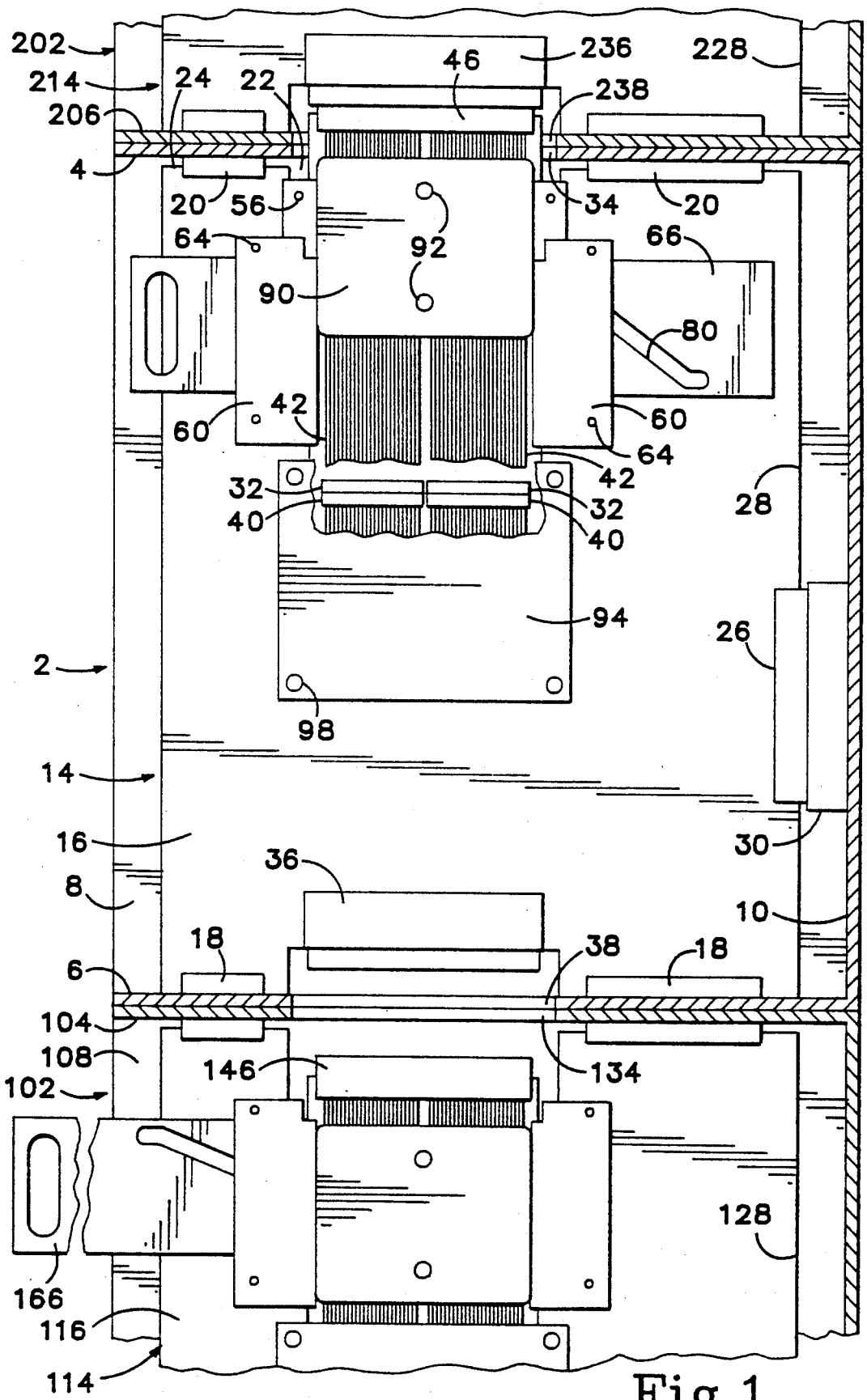
FIG. 1 is a vertical sectional view showing part of an electronic instrument composed of circuit boards mounted in a card cage.
Figure 2:
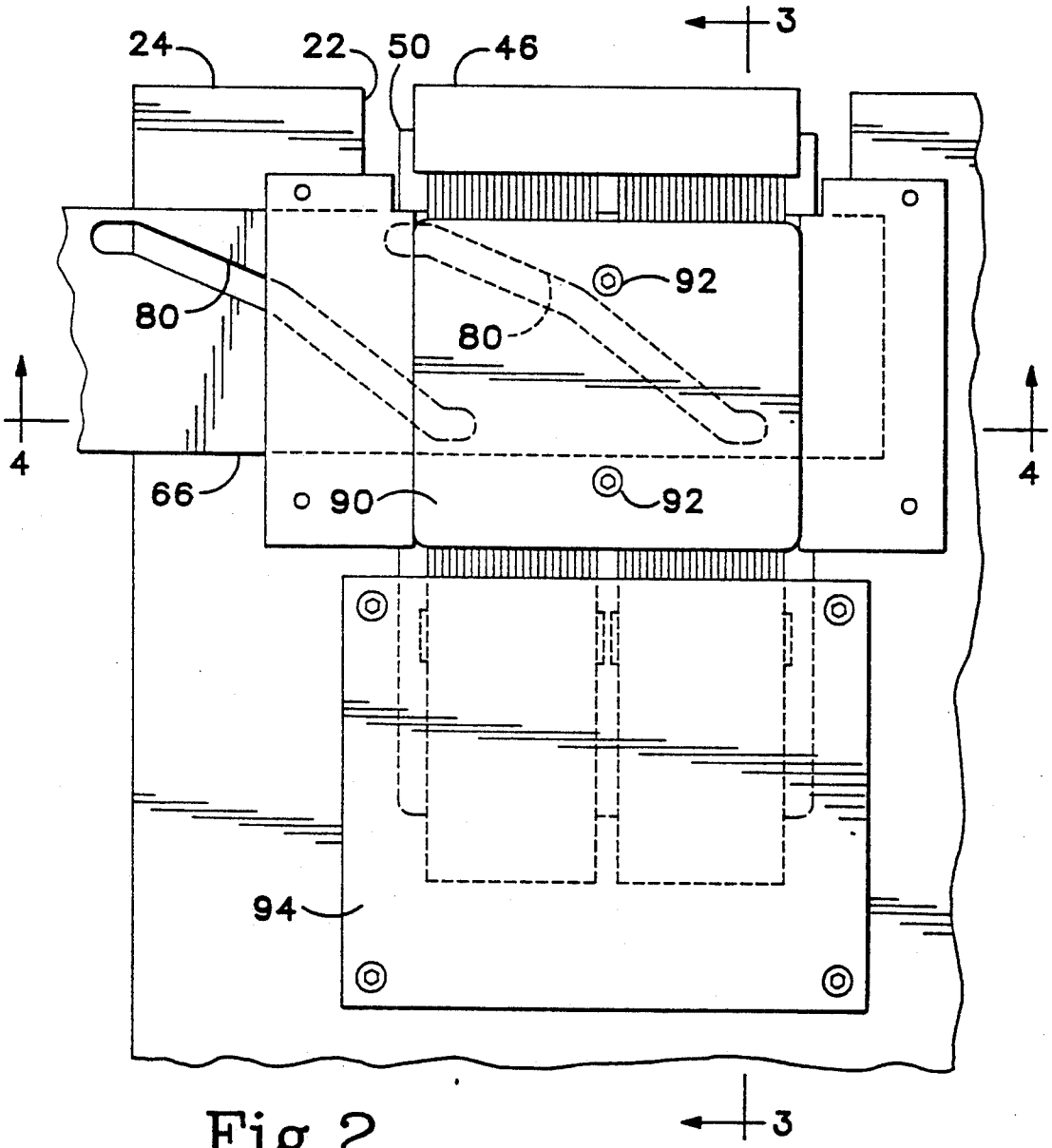
FIG. 2 is an enlarged view of part of one of the circuit boards shown in FIG. 1.

The instrument shown in FIG. 1 comprises a card cage composed of stacked frames for receiving circuit boards. FIG. 1 illustrates an input frame 2 which has horizontal walls 4, 6, a side wall 8, an opposite side wall (not shown) and a back wall 10. One of the circuit boards, designated 14, is shown in FIG. 1. The circuit board 14 is an input board and comprises a substrate 16 and various electronic components (not shown) mounted on the substrate. The electronic components implement a crosspoint switch module having signal in terminals, signal out terminals, input expansion terminals, a control in terminal and a control out terminal, as described in the copending application Ser. No. 07/614,230. The circuit board 14 is disposed vertically in the frame 2 and has a lower edge resting in guides 18 and an upper edge engaging guides 20. The substrate 16 is generally rectangular, except for a rectangular recess 22 at its upper edge 24. The circuit board includes a male connector part 26 attached to the substrate at its rear edge 28 and engaging a complementary female connector part 30 that is mounted on the back wall 10. The connector 26, 30 is used to supply operating current from a power supply (not shown) to the components on the substrate 16 and to connect signal sources to the signal in terminals of the crosspoint switch module. The circuit board includes a first set of conductor runs (not shown) terminating at respective pins of the connector part 26, a second set of conductor runs (not shown) terminating at respective pins of female connector parts 32 and a third set of conductor runs (not shown) terminating at pins of a male connector part 36. The connector parts 32 are in mating engagement with respective male connector parts 40. The male connector parts 40 are connected through respective ribbon cables 42 to a female connector part 46 that is complementary to the male connector part 36.

Referring to FIGS. 1–4, the female connector part 46 is mounted on a plate 50 that is situated in the recess 22 at the upper edge of the substrate and is held between retaining plates 52, 54, which are clamped together by screws 56. The dimension of the retaining plates 52, 54 in the direction of the upper edge 24 of the substrate exceeds the dimension of the recess 22 in that direction. Guide blocks 60 are attached to the circuit board by screws 64 and limit movement of the assembly 50–54 in the direction of the upper edge 24, so that the mounting plate 50 remains in the recess 22. A cam plate 66 extends through two aligned slots 70 in the guide blocks. The guide blocks are also formed with grooves 74 at their confronting edges, and a guide plate 78 is fitted slidingly in those grooves.

Figure 5:
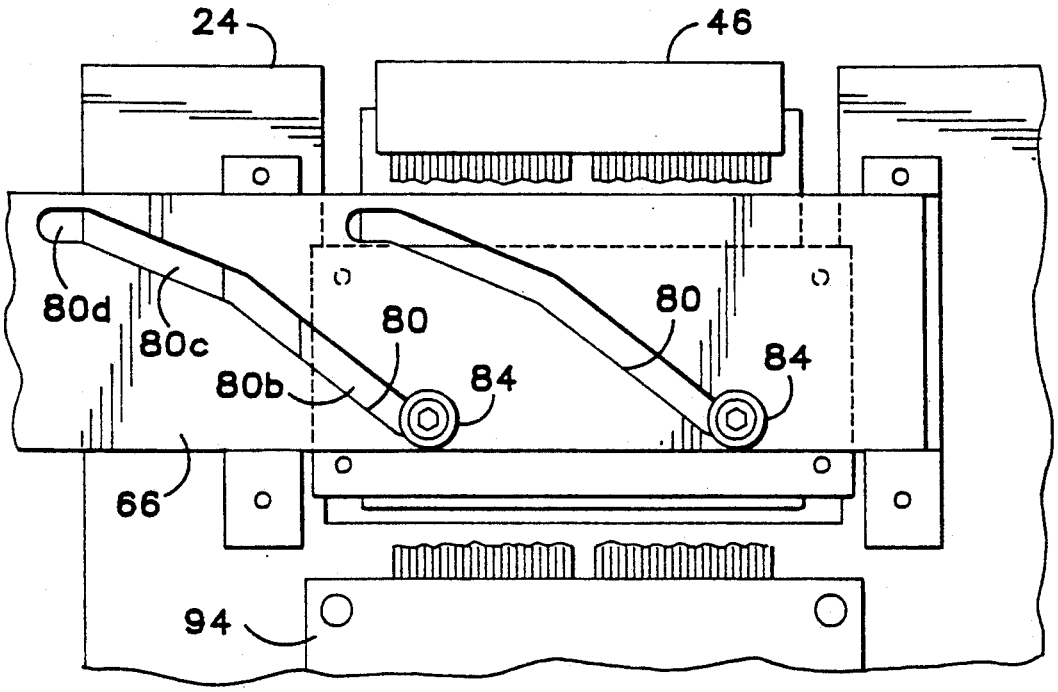
FIG. 5 is a partial elevation of the circuit board in a first condition.
Figure 6:
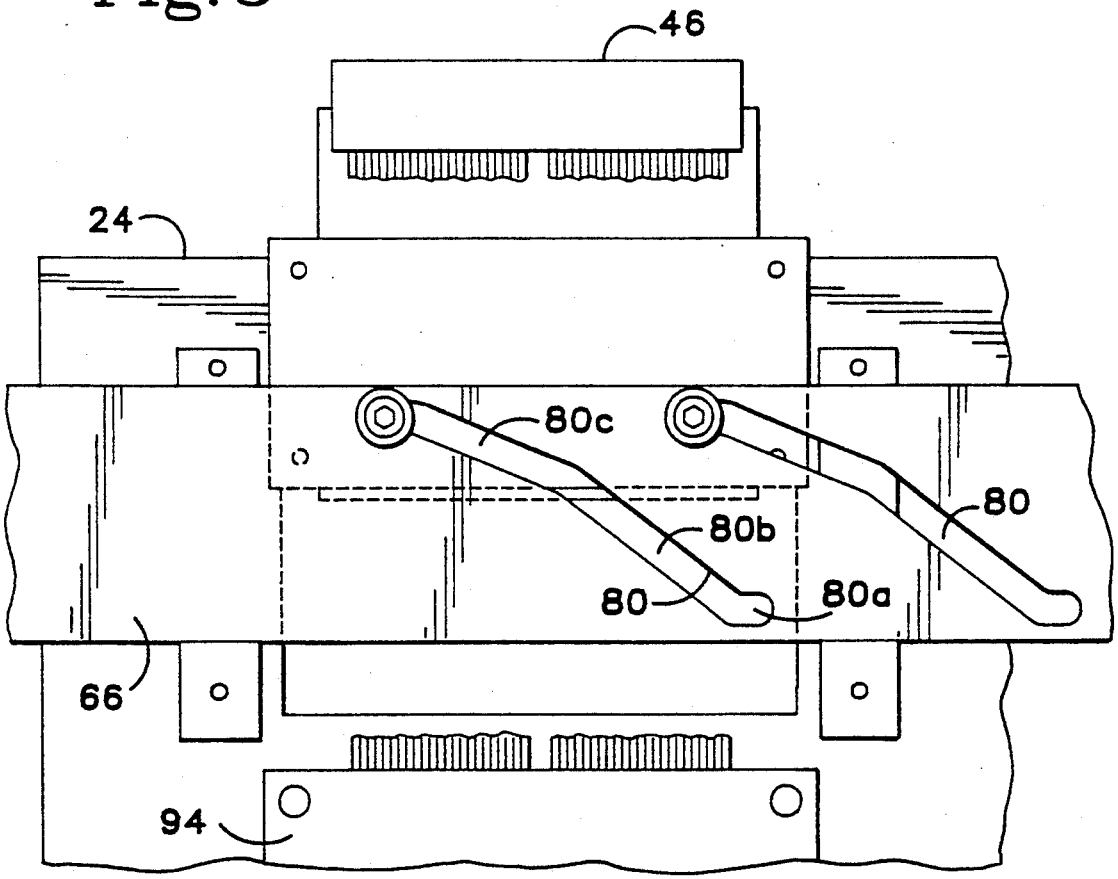
FIG. 6 is a view similar to FIG. 5 showing the circuit board in a second condition.

The cam plate 66 is formed with two cam slots 80, and follower screws 84 pass through the slots 80 respectively and are in threaded engagement with the assembly 50–54. The screws 84 have shanks that extend within the slots and have heads of which the diameter is greater than the maximum width of the slots. The slots extend at about 30° relative to the edge 24 of the substrate, and consequently by displacing the cam plate 66 horizontally from the position shown in FIG. 5 to the position shown in FIG. 6, the assembly 50–54 is displaced vertically relative to the substrate 16.

Figure 3:
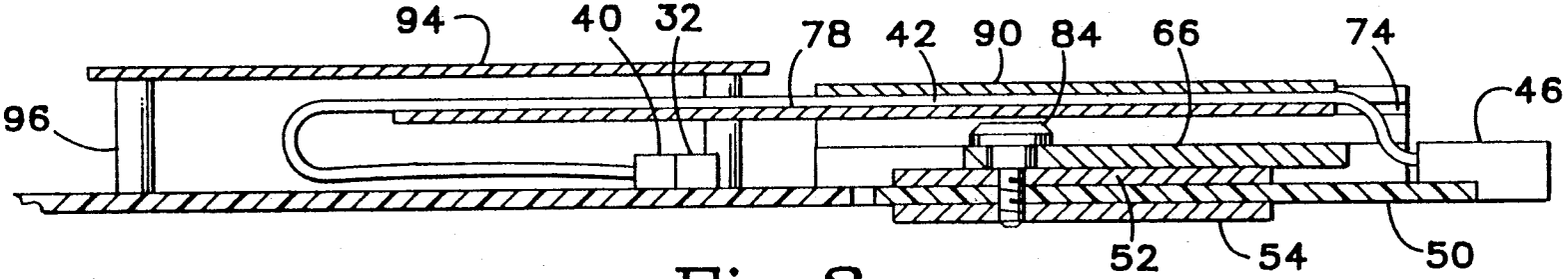
FIG. 3 is a sectional view taken on the line 3—3 of FIG. 2.
Figure 4:
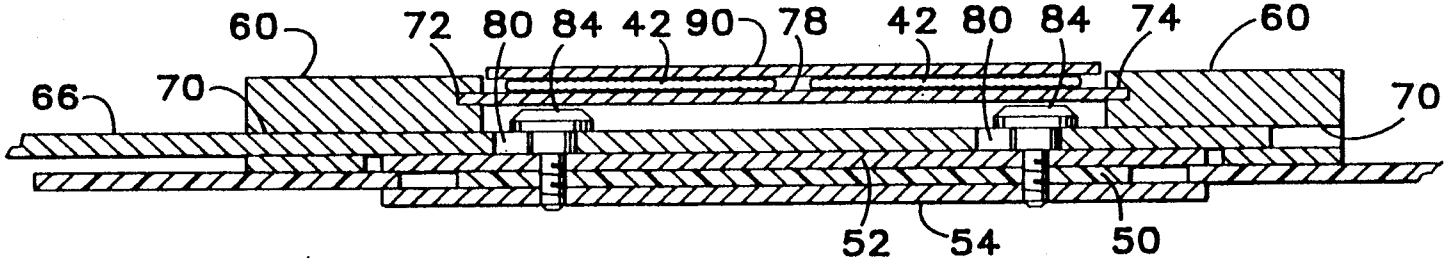
FIG. 4 is a sectional view taken on the line 4—4 of FIG. 2.

As shown in FIG. 3, the ribbon cables 42 extend on the opposite side of the plate 78 from the cam plate, and consequently the plate 78 prevents contact between the cam plate and the ribbon cables, such as might cause the cables to be damaged. The cables are sandwiched between the guide plate 78 and a retainer plate 90, which is attached to the plate 78 by screws 92. A cable cover plate 94 is secured to the substrate by screws 98 and is held in spaced relationship with the substrate 16 by standoffs 96. The upper edge of the cover plate 94 is close to the lower edge of the retainer plate 90 when the cam plate is in the position shown in FIG. 6, and the lower end of the plate 78 extends between the cover plate 94 and the substrate 16. Accordingly, when the cam plate is displaced from the position shown in FIG. 6 to the position shown in FIG. 5, the ribbon cable is fed between the cover plate 94 and the substrate 16 and does not buckle out away from the substrate 16.

The clearance between the guide blocks 60 and the plate 52 allows limited movement of the assembly 50–54 parallel to the upper edge 24 of the substrate. The guide plate 78 has a more limited range of movement in that direction and is connected to the assembly 50–54 through the ribbon cables 42 and the female connector part 46. Accordingly, the assembly 50–54 is effectively restrained with respect to movement parallel to the upper edge of the substrate to the range allowed by the guide plate 78 and the ribbon cables 42.

The input frame 2 is mounted on top of an output frame 102, and a second input frame 202 is mounted on top of the frame 2. The frames 2, 102, 202 are secured together by means of screws or other attachment devices (not shown). Elements that are associated with the frames 102 and 202 are distinguished from corresponding elements associated with the frame 2 by reference numerals in the series 1XX and 2XX respectively.

Input boards, each of which may be identical to the circuit board 14, are received in frame 202. One of the input boards in the frame 202 is shown in FIG. 1 and is designated 214. The frame 102 contains output boards and also contains the power supply, and one of the output boards in the frame 102 is shown in FIG. 1 and is designated 114. The output board 114 includes a female connector part 146 that is mounted to the substrate 116 in the same way as the connector part 46 is mounted to the substrate 16. The substrates of the boards 14, 114 and 214 are essentially coplanar, and their rear edges 28, 128 and 228 are essentially collinear. The horizontal walls 4, 6, 104, 206 of the frames are formed with respective apertures 34, 38, 134, 238. The attachment devices that secure the frames ensure that the apertures 34, 238, for example, are vertically aligned. FIG. 1 shows the connector part 46 in engagement with the connector part 236. As shown in FIG. 1 by comparison of the circuit boards 114 and 14, when the cam plate 166 is displaced from the position shown in FIG. 5 to the position shown in FIG. 6, the female connector part 146 is driven through the aligned apertures 38, 134 into engagement with the male connector part 36. In this fashion, connections between circuit boards 14 and 114 are readily accomplished.

It will be seen from the foregoing that the sliding mount for the connector part 46 allows the circuit board 14 to be inserted in the input frame 2 by linear motion along a first axis and to be connected to other circuitry in a manner providing signal flow along a second axis, perpendicular to the first axis, without translating the circuit board 14 or the other circuitry along the second axis. Further, the sliding mount allows board-to-board connections, particularly signal and control connections in a rectangular switch matrix in which the matrix is distributed over multiple boards, to be established when the boards are inserted in the card cage without use of a so-called mother board.

The connector 236, 46 delivers signals provided by the signal out terminals of the switch module of the input board 214 to the signal in terminals of the switch module of the input board 14 and the connector 36, 146 delivers signals from the signal out terminals of the switch module of the input board 14 to terminals of components mounted on the output board 114. Similarly, the connector 36, 146 delivers a control signal from the output board 114 to the control in terminal of the switch module on the input board 14 and the connector 236, 46 delivers a control signal from the control out terminal of the switch module on the input board 14 to the control in terminal of the switch module on the input board 214.

When it is desired to remove the circuit board 14, for example, from the card cage, the cam plates 66 and 166 are pulled to the left of FIG. 1 and the connector parts 46 and 146 are withdrawn from the connector parts 236 and 36 respectively to positions in which they are in non-interfering relationship with respect to the card cage, and the circuit board 14 can then be removed.

Referring again to FIGS. 5 and 6, it will be seen that the cam slots 80 each have four distinct segments. The segments 80*a* and 80*d* are horizontal, whereas the segment 80*b* is inclined at about 36° to the horizontal and the segment 80*c* is inclined at about 22° to the horizontal. The horizontal segments 80*a* and 80*d* ensure that when the followers are in one of these segments, force applied to the connector part 46 in the direction perpendicular to the upper edge 24 of the substrate 14 will not result in movement of the connector part. Thus, when the connector part 46 is engaged with the connector part 236, it will not become disengaged due to the force of gravity or vibration, but only if the cam plate 66 is moved toward the left in FIG. 1. The segment 80*b* is more steep than the segment 80*c*. Thus, during the initial part of movement from the position shown in FIG. 5 toward the position shown in FIG. 6 in which the connector part 46 does not encounter connector insertion force, the mechanical advantage of the cam and follower arrangement is quite low and the displacement of the connector part 46 per unit displacement of the cam plate 66 is high. When the followers enter the segment 80*c*, the mechanical advantage increases, and accordingly the amount of effort required to displace the cam plate to the end of its travel against the resistance due to connector insertion force is less than if the segment 80*c* had been of the same slope as the segment 80*b*.

By use of two parallel cam slots and two cam followers, the assembly 50–54 is prevented from tilting in the recess 22.

The instrument shown in FIGS. 1–6 can be expanded to support additional signal sources by mounting an extra input frame on top of the frame 202 and installing input boards in the extra frame. The only connections that need to be made to the back wall connector are for power supply and for connection to the signal sources, since all inter-board connections (both signal and control) are made by way of the sliding cam connectors and without use of a backplane structure.

It will be appreciated that the invention is not restricted to the particular embodiment that has been described, and that variations may be made therein without departing from the scope of the invention as defined in the appended claims and equivalents thereof.

We claim:

1. A circuit board comprising:

a generally planar substrate having first and second opposite edges, a first connector part attached to the substrate at its first edge, a second connector part, complementary to the first connector part, and mounting means attaching the second connector part to the substrate at its second edge in a manner allowing forcible movement of the second connector part relative to the substrate in a direction having a component perpendicular both to the second edge and to a line normal to the substrate, whereby when said circuit board and a second circuit board that is identical to the first-mentioned circuit board are held in substantially coplanar relationship with the first connector part of the second circuit board spaced from but presented toward the second connector part of the first-mentioned circuit board, the mounting means of the first-mentioned circuit board can be employed to advance the second connector part of that circuit board from a first position in which it is spaced from the first connector part of the second circuit board to a second position in which it engages the first connector part of the second circuit board.

2. A circuit board according to claim 1, wherein the mounting means comprise a plate that is substantially coplanar with the substrate, means for guiding movement of the plate in said direction, and means for urging the plate to move in said direction.

3. A circuit board according to claim 2, wherein the substrate is formed with a recess at its second edge and the mounting means comprise means for retaining the mounting plate in said recess.

4. A circuit board according to claim 2, wherein the means for urging the plate to move comprise a cam plate defining at least one cam slot extending obliquely to said direction, and a cam follower attached to the mounting plate and extending within the cam slot.

5. A circuit board according to claim 4, wherein the cam slot has a first segment of lower mechanical advantage and a second segment of higher mechanical advantage.

6. A circuit board according to claim 4, wherein the cam slot has a segment that is oblique to said direction and a segment that is perpendicular to said direction, whereby when the follower is in the last-mentioned segment, force applied to the second connector part in said direction will not cause movement of the cam plate.

7. A circuit board according to claim 4, wherein the cam plate has two parallel cam slots and two followers that are attached to the mounting plate and extend within the cam slots respectively.

8. A circuit board according to claim 1, comprising a third connector part attached to the substrate at a location spaced from the second edge, a flexible cable extending between the second connector part and the third connector part, and means for preventing buckling of the flexible cable when the second connector part is moved from its second position to its first position.

9. An electronic instrument comprising:

a first circuit board comprising a substrate and a connector part attached to the substrate at an edge thereof, a second circuit board comprising a substrate, a connector part that is complementary to the connector part of the first circuit board, and mounting means attaching the complementary connector part of the second circuit board to the substrate thereof at an edge of the substrate in a manner allowing forcible movement of said complementary connector part relative to the substrate in a direction having a component perpendicular both to said edge and to a line normal to the substrate of the second circuit board, and means supporting the first and second circuit boards so that their substrates are in substantially coplanar relationship and the connector part of the first circuit board is presented toward the connector part of the second circuit board, whereby the mounting means can be employed to advance said complementary connector part of the second circuit board into engagement with the connector part of the first circuit board.

10. An instrument according to claim 9, wherein the second circuit board has a second edge substantially perpendicular to the edge at which said complementary connector part is attached to the substrate, the second circuit board further comprises a second connector part attached to the substrate at said second edge thereof, and the means supporting the circuit boards comprise a connector part that is complementary to the second connector part of the second circuit board for receiving the second connector part of the second circuit board.

11. An instrument according to claim 9, wherein the second circuit board has a second edge substantially parallel to the edge at which said complementary connector part is attached to the substrate, the second circuit board further comprises a second connector part attached to the substrate at the second edge thereof, said second connector part being substantially identical to the connector part of the first circuit board, and the instrument further comprises:

a third circuit board comprising a substrate, a connector part that is complementary to the second connector part of the second circuit board, and mounting means attaching the connector part of the third circuit board to the substrate thereof at an edge of the substrate in a manner allowing forcible movement of the connector part relative to the substrate in a direction having a component perpendicular both to said edge and to a line normal to the substrate of the third circuit board, and wherein the third circuit board is supported so that its substrate is substantially coplanar with the substrate of the second circuit board and the second connector part of the second circuit board is presented toward the connector part of the third circuit board, whereby the mounting means of the third circuit board can be employed to advance the connector part of the third circuit board into engagement with the second connector part of the second circuit board.

* * * * *